US011172720B2

(12) United States Patent
Flack

(10) Patent No.: US 11,172,720 B2
(45) Date of Patent: Nov. 16, 2021

(54) HELMET WITH CHIN CRUSH ZONE AND INTEGRATED VENTILATION

(71) Applicant: Darryl Rodney Flack, Gladesville (AU)

(72) Inventor: Darryl Rodney Flack, Gladesville (AU)

( * ) Notice: Subject to any disclaimer, the term of this patent is extended or adjusted under 35 U.S.C. 154(b) by 0 days.

(21) Appl. No.: 16/309,213

(22) PCT Filed: Jun. 14, 2017

(86) PCT No.: PCT/AU2017/050593
§ 371 (c)(1),
(2) Date: Dec. 12, 2018

(87) PCT Pub. No.: WO2017/214670
PCT Pub. Date: Dec. 21, 2017

(65) Prior Publication Data
US 2019/0261720 A1 Aug. 29, 2019

(30) Foreign Application Priority Data
Jun. 14, 2016 (AU) ..... 2016902299

(51) Int. Cl.

| | |
|---|---|
| ***A42B 3/08*** | (2006.01) |
| ***A42B 3/28*** | (2006.01) |
| ***A42B 3/06*** | (2006.01) |
| ***A42B 3/12*** | (2006.01) |
| ***A42B 3/22*** | (2006.01) |
| ***A42B 3/32*** | (2006.01) |

(52) U.S. Cl.
CPC ..... *A42B 3/065* (2013.01); *A42B 3/08* (2013.01); *A42B 3/124* (2013.01); *A42B 3/22* (2013.01); *A42B 3/281* (2013.01); *A42B 3/326* (2013.01)

(58) Field of Classification Search
CPC ..... A42B 3/281; A42B 3/283; A42B 3/065; A42B 3/08; A42B 3/205; A42B 3/326; A42B 3/0473; A61F 9/028
USPC ..... 2/171.3, 171.4, 413, 414, 424
See application file for complete search history.

(56) References Cited

U.S. PATENT DOCUMENTS

| | | | | |
|---|---|---|---|---|
| 4,627,115 A | | 12/1986 | Broersma | |
| 4,700,411 A | * | 10/1987 | Kawasaki | A42B 3/283 2/171.3 |
| 5,058,212 A | * | 10/1991 | Kamata | A42B 3/283 2/424 |
| 5,212,843 A | * | 5/1993 | Kamata | A42B 3/06 2/171.3 |
| 5,694,650 A | * | 12/1997 | Hong | A42B 3/28 2/424 |

(Continued)

FOREIGN PATENT DOCUMENTS

| | | |
|---|---|---|
| DE | 253760 | 2/1988 |
| FR | 2566632 | 1/1986 |

(Continued)

*Primary Examiner* — Katherine M Moran
(74) *Attorney, Agent, or Firm* — Sand, Sebolt & Wernow Co., LPA

(57) ABSTRACT

A chin-bar for a helmet with a crumple zone and an integrated air-flow system formed from passages running internally from the bottom to the top of the chin-bar. A scoop at the bottom of the chin-bar controls air flow. Diffusers at the top provide de-misting and fresh air to the rider.

12 Claims, 5 Drawing Sheets

(56) References Cited

U.S. PATENT DOCUMENTS

| | | | | |
|---|---|---|---|---|
| 5,758,639 | A * | 6/1998 | Ikonen | A42B 3/28 128/201.14 |
| 6,481,019 | B2 * | 11/2002 | Diaz | A41D 13/11 128/201.19 |
| 7,735,157 | B2 * | 6/2010 | Ikeda | A42B 3/281 2/410 |
| 9,282,779 | B2 * | 3/2016 | Domenico | A42B 3/283 |
| 10,709,911 | B2 * | 7/2020 | Pavalarajan | A42B 3/286 |
| 2005/0278833 | A1 * | 12/2005 | Pierce | A42B 3/281 2/424 |
| 2007/0113318 | A1 | 5/2007 | Weston | |
| 2008/0307568 | A1 | 12/2008 | Sajic | |
| 2015/0047110 | A1 | 2/2015 | Chilson | |
| 2018/0279711 | A1 * | 10/2018 | Szalkowski | F41H 1/04 |

FOREIGN PATENT DOCUMENTS

| | | |
|---|---|---|
| GB | 2184640 | 7/1987 |
| JP | S56156834 | 11/1981 |
| JP | S58-34925 | 3/1983 |
| JP | S61132604 | 6/1986 |
| WO | 9005464 | 5/1990 |

* cited by examiner

HELMET WITH CHIN CRUSH ZONE AND INTEGRATED VENTILATION

FIELD OF THE INVENTION

The present invention relates to a protective helmet, in particular a helmet suitable for motorcycle riders with a chin-bar incorporating a crumple zone and improved ventilation.

BACKGROUND TO THE INVENTION

This invention relates to a protective helmet with improved chin protection and ventilation. Whist the helmet is particularly suited for everyday motorcycle riding, it is also suited for on-road, off-road and adventure motorcycling; motorcycle racing including road racing, drag racing, motocross, supercross, enduro, speedway, dirt-track and rally, as well as motor car racing; circuit racing, oval racing, drag racing, speedway, off-road racing, autocross, drifting, go-karting and rally; mountain bike riding, mountain bike and BMX racing, snow sports, cricket, and horse riding and horse racing. The improvements may be applied to both full-face helmets and modular full-face helmets Full-face helmets offer protection to the chin during a fall and have prevented many grazed faces, mandible (jaw), dental and facial injuries. However, unlike the main portion of a helmet which is designed to crumple and absorb energy when impacted, the chin-bar of a full-face helmets are typically rigid and therefore transmit shock when impacted. The shock is transmitted to the base of the skull and is believed to be responsible for many deaths resulting from basilar skull fractures. Some members of the motorcycling community choose to wear open-face helmets to prevent such fatal injuries, albeit at the expense of a badly scraped chin and/or facial/mandible fractures in the event of an accident.

Ventilation is important in fixed-faced helmets to prevent the visor from fogging up. Typically triangular or rectangular vent holes are included below the visor and close to the edge of the helmet at the top of the chin-bar. These holes are known to create easy fracture paths during impact.

The object of this invention is to provide a helmet to alleviate the above problem, or at least provide the public with a useful alternative.

SUMMARY OF THE INVENTION

In a first aspect the invention provides a chin-bar for a helmet comprising a body, a top and a bottom, wherein the body includes vertical passageways extending from the bottom to the top.

Preferably the passageways form a crumple zone and are sized to allow airflow from the bottom to the top.

In preference the bottom comprises a vent to controllably restrict airflow to the passageways and the top comprises at least one diffuser disposed above the passageways.

Preferably the passageways are disposed in a tessellated pattern and are hexagonal in cross section.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DRAWING COMPONENTS

Figure 1:
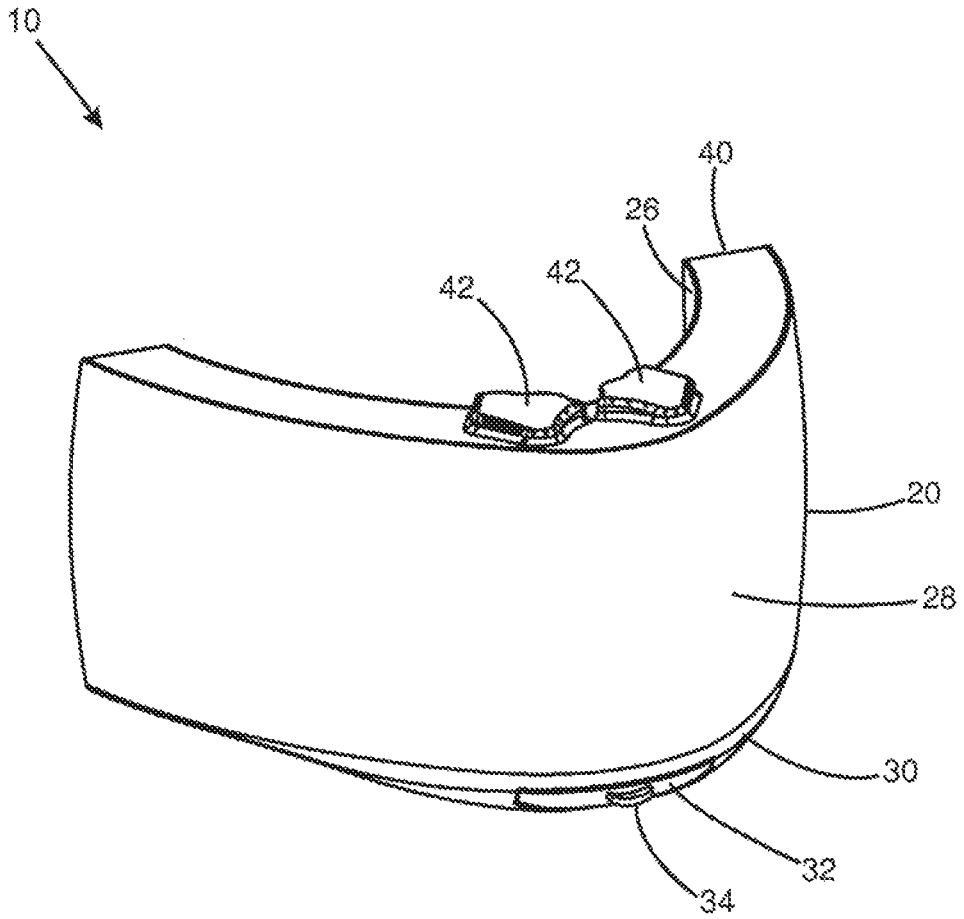
FIG. 1 shows a front perspective view of a chin-bar incorporating the present invention.

The drawings include the following integers.

10 chin-bar
20 body
22 core
24 cells
26 inner shell
28 outer shell
30 bottom (of chin-bar)
32 vent
34 handle
36 chamber
38 outlet apertures
40 top (of chin-bar)
42 diffuser
44 inlet apertures
46 visor
48 helmet

DETAILED DESCRIPTION OF THE INVENTION

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

Figure 5:
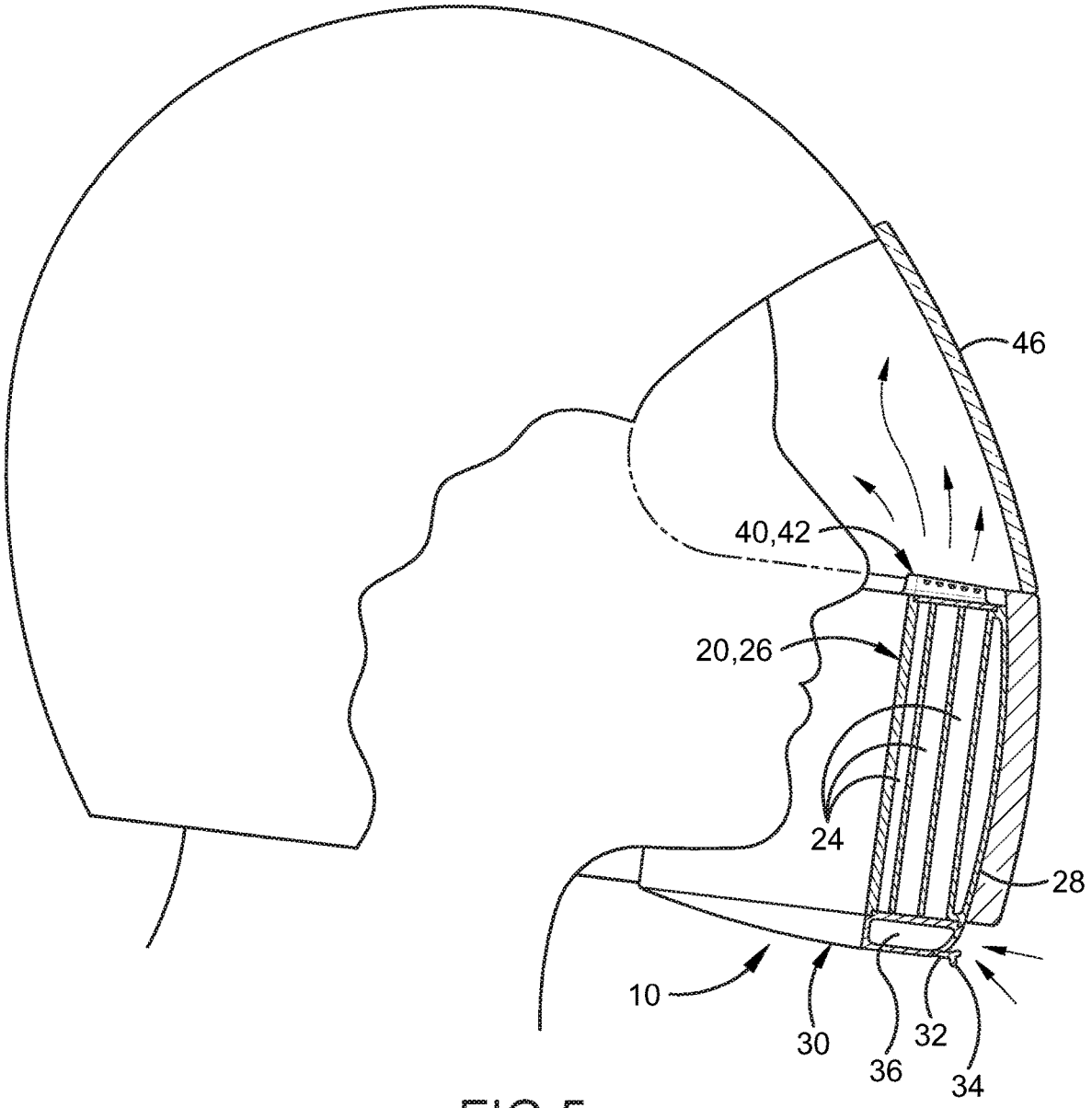
FIG. 5 shows a partial cross-sectional, side elevation view of a helmet on a head of a rider and showing the chin bar in accordance with FIGS. 1 to 4.

The present invention provides a crumple zone for a chin-bar of a helmet 48 (FIG. 5) that incorporates vertical passageways that allow air to pass up through the chin-bar to provide ventilation for the visor 46 without compromising the design integrity of the helmet 48. The chin-bar can be manufactured as a separate or fully-integrated component, to better maintain the strength of the chin-bar and better absorb and dissipate energy resulting from low-speed impacts with the chin-bar to improve protection for the rider. The hexagonal or tri-hexagonal crumple zone will afford improved and multi-directional energy management in the event of an impact with the chin-bar. The invention's air-flow system helps to de-mist a full-face helmet visor 46 and provide sufficient oxygen flow to the rider without interrupting the design integrity of the crumple zone inside the chin-bar.

An external view of a chin-bar 10 incorporating the invention is shown as 10 in FIG. 1. The chin-bar appears similar to conventional chin-bars, but includes a hinged bottom vent 32 on the bottom 30 of the chin-bar to controllably admit air, and diffusers 42 on the top 40 of the chin-bar to direct airflow onto the inside surface of a visor 46 and onto a rider's face. The bottom vent 32 includes a tab/handle 34 to aid in manipulation of the vent opening and thus air flow. Notably the outer shell 28 of the chin-bar is not compromised by holes.

Figure 2:
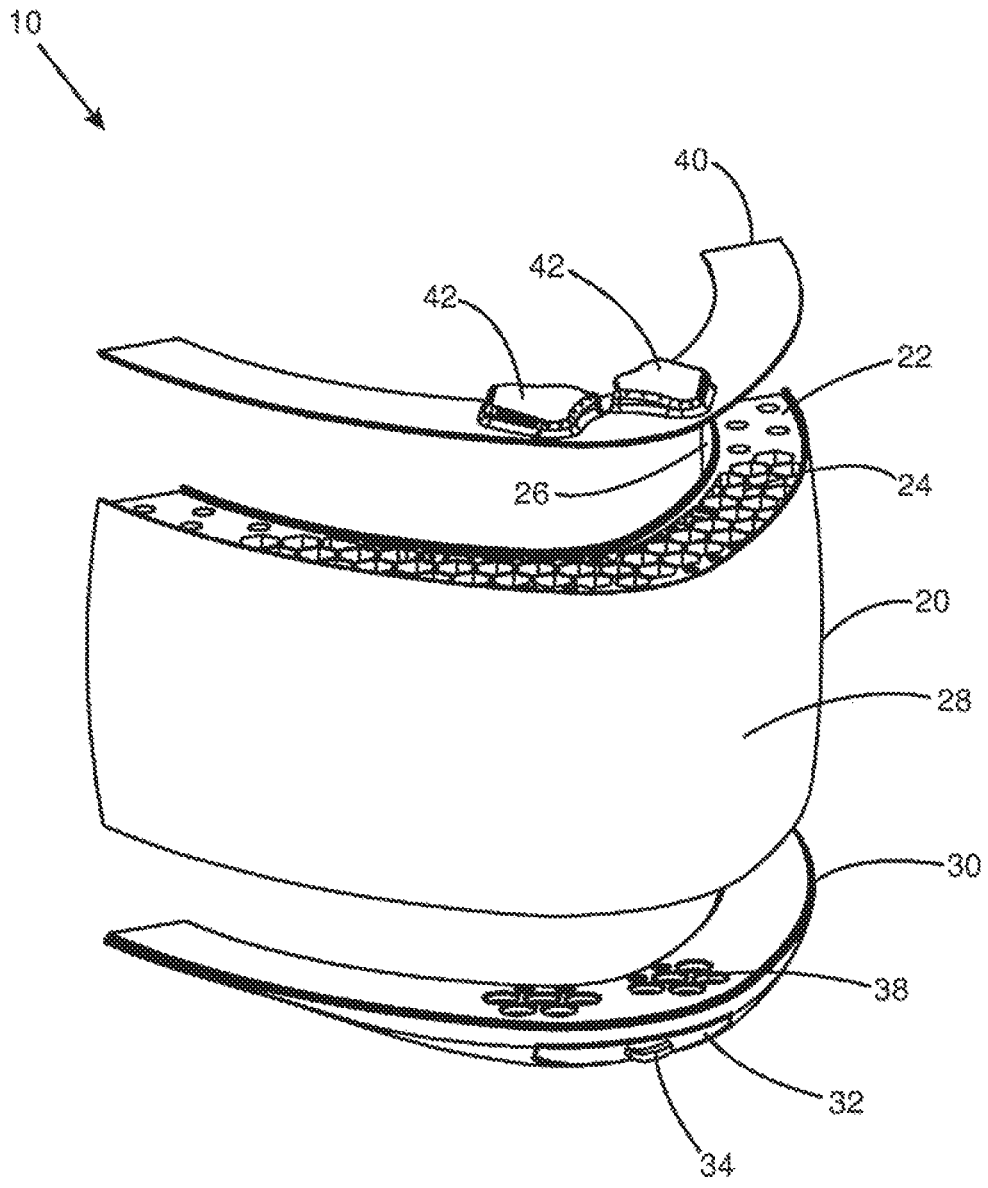
FIG. 2 shows an exploded view of the chin-bar.
Figure 3:
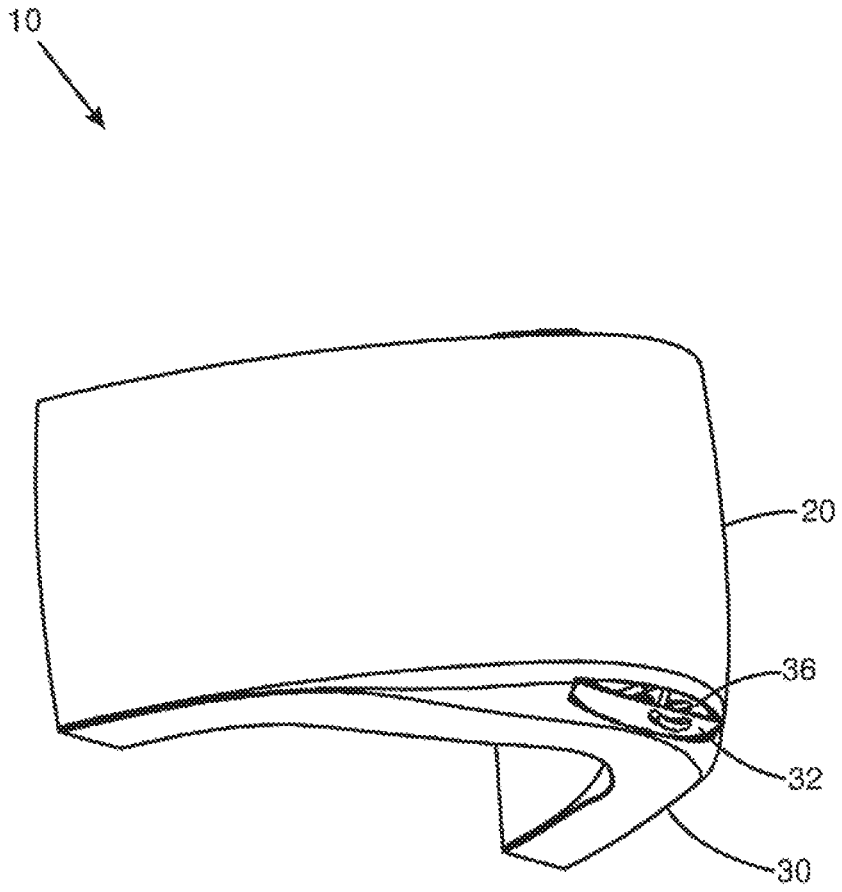
FIG. 3 shows a perspective view of the chin-bar from blow with the bottom vent open.
Figure 4:
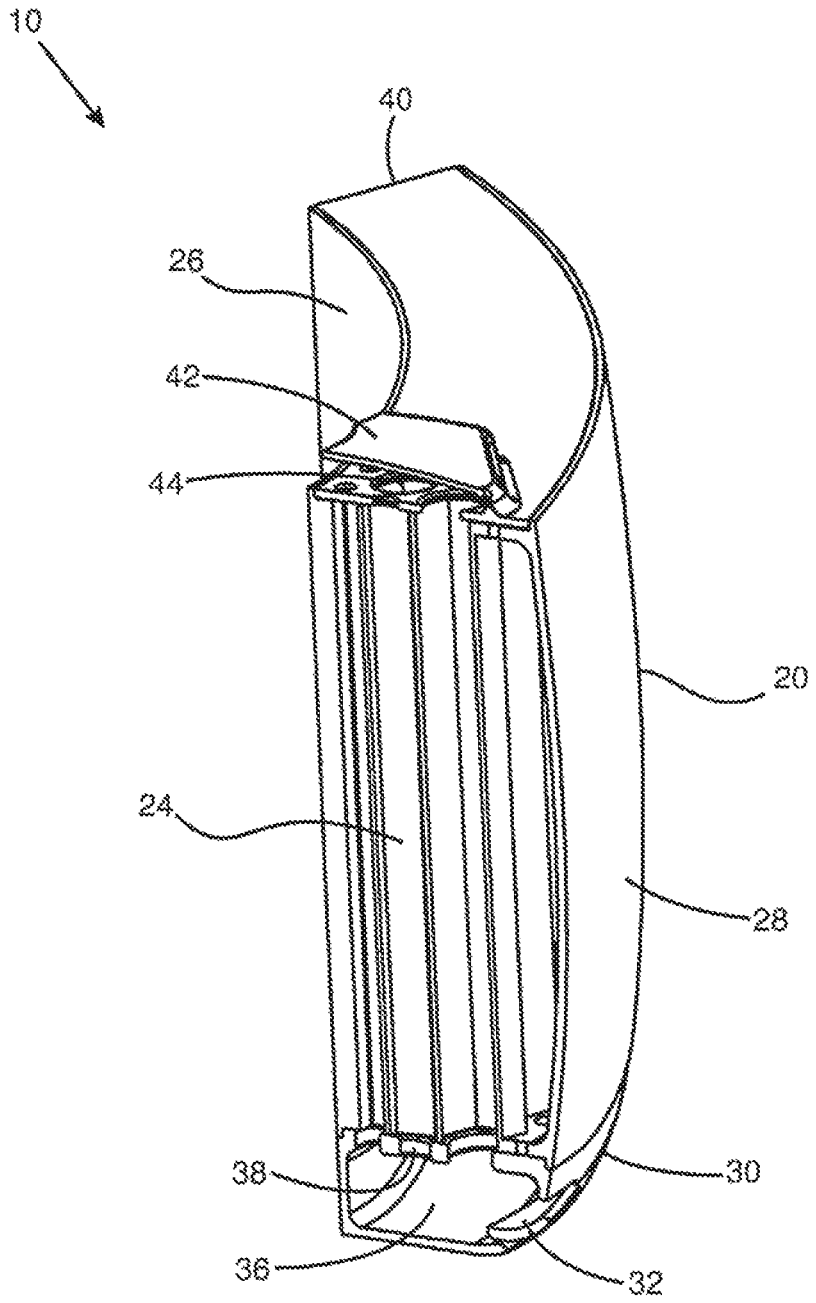
FIG. 4 shows a cutaway view of the chin-bar.

FIG. 2 shows an exploded view of the chin-bar 10 which can be seen to comprise three main components, body 20, bottom 30 and top 40. Internal details of the chin-bar are best appreciated with the cutaway view of FIG. 4. The body 20 comprises a core 22 between an inner shell 26 and an outer shell 28. The inner and outer shells can be made as per conventional helmets from materials such as fibreglass moulds, fibreglass/carbon-fibre/Kevlar/aramid composite moulds, or poly-carbonate or other plastic-based helmet moulds. The core 22 can also be made from a variety of materials such as fibreglass plastic, carbon-fibre, aluminium alloy and other alloys, plastics, nylons, synthetics, and urethanes and may be manufactured as a discrete unit to allow for easy replacement or fully integrated with the inner and outer shells. The core includes an array of vertical cells/passageways 24 that provide an energy absorbing crumple zone as well as a path for air to flow through the body. The cells 24 are preferably tessellated and may be a honeycomb as shown, tri-hexagonal pattern or various other cross sections. The bottom section 30 includes a single hinged intake scoop 32 (shown open in FIG. 3) located at centre/front section of the bottom that directs air via chamber 36 up through outlet apertures 38 and into the bottom of cells 24. The airflow exits the top of the cells 24 and through inlet apertures 44 of the diffusers 42 from where it is directed over the inside surface of a visor 46 of a helmet 48 for de-misting and over the riders face.

The reader will now appreciate the present invention which provides a chin-bar with a crumple zone and an integrated air-flow system that provides adequate oxygen flow to the rider and face port without compromising the structural integrity of the crumple zone as with conventional air-flow ports. By using the crumple zone cells to channel the air flow to the helmet face port, there is no requirement to cut into the upper section of the crumple zone and outer chin-bar to install conventionally mounted air vents. The diffusers optimise both de-misting of the visor 46 and general aeration for the rider. The honeycomb pattern or tri-hexagonal pattern crumple zone affords multi-directional impact loading and deformation to better manage forces in low-speed collisions with the chin-bar. The honeycomb pattern crumple zone deformation rate can be tuned for different helmet users, adults and children, and for different environments; on-road motorcycling, off-road motorcycling/bicycling, motorcycle road racing, motocross, Supercross, enduro and rally; as well as motorsports, snow sports, cricket and horse riding/racing.

Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A chin-bar for a helmet with a visor, said chin-bar comprising:

a body having a wall with a top and a bottom, wherein the body includes vertical passageways extending from an opening defined in the bottom of the wall of the body to an opening defined in the top of the wall of the body, wherein the chin-bar is adapted to be located below the visor and to cover a chin of a person wearing the helmet; and wherein the passageways are adapted to provide ventilation to the visor on the helmet.

2. The chin-bar as in claim 1, wherein the passageways form a crumple zone.

3. A chin-bar for a helmet with a visor, said chin-bar comprising:

a body having a wall with a top and a bottom, wherein the body includes vertical passageways extending from an opening defined in the bottom of the wall of the body to an opening defined in the top of the wall of the body, wherein the chin-bar is adapted to be located below the visor and to cover a chin of a person wearing the helmet; and wherein the passageways are adapted to provide ventilation to the visor on the helmet, and wherein the bottom comprises a vent to controllably restrict airflow to the passageways.

4. A chin-bar for a helmet with a visor, said chin-bar comprising:

a body having a wall with a top and a bottom, wherein the body includes vertical passageways extending from an opening defined in the bottom of the wall of the body to an opening defined in the top of the wall of the body, wherein the chin-bar is adapted to be located below the visor and to cover a chin of a person wearing the helmet; and wherein the passageways are adapted to provide ventilation to the visor on the helmet, and wherein the top comprises at least one diffuser disposed above the passageways.

5. A chin-bar for a helmet with a visor, said chin-bar comprising:

a body having a wall with a top and a bottom, wherein the body includes vertical passageways extending from an opening defined in the bottom of the wall of the body to an opening defined in the top of the wall of the body, wherein the chin-bar is adapted to be located below the visor and to cover a chin of a person wearing the helmet; and wherein the passageways are adapted to provide ventilation to the visor on the helmet, wherein the passageways form a crumple zone, and wherein the passageways are disposed in a tessellated pattern.

6. The chin-bar as in claim 5, wherein the passageways are hexagonal in cross section.

7. A helmet comprising:

a helmet body;

a visor provided on the helmet body;

a chin-bar engaged with the helmet body in a location vertically below the visor; said chin-bar including a chin-bar body having a wall with a top and a bottom, wherein the chin-bar body includes vertical passageways extending from an opening defined in the bottom of the wall of the chin-bar body to an opening defined in the top of the wall of the chin-bar body; and wherein the chin-bar is adapted to protect a chin of a person wearing the helmet, and wherein the passageways in the chin-bar body provide ventilation to the visor.

8. The helmet as in claim 7, wherein the passageways form a crumple zone.

9. The helmet as in claim 8, wherein the passageways are disposed in a tessellated pattern.

10. The helmet as in claim 9, wherein the passageways are hexagonal in cross section.

11. The helmet as in claim 7, wherein the bottom comprises a vent to controllably restrict airflow to the passageways.

12. The helmet as in claim 7, wherein the top comprises at least one diffuser disposed above the passageways.

* * * * *